United States Patent [19]

Atkinson et al.

[11] Patent Number: 4,867,373

[45] Date of Patent: Sep. 19, 1989

[54] CARTON DIVIDER INCORPORATING 3-PLY LIFTING HANDLE

[75] Inventors: William G. Atkinson; Thomas K. Dews, both of London, Canada

[73] Assignee: Paperboard Industries Corporation, London,, Canada

[21] Appl. No.: 209,970

[22] Filed: Jun. 22, 1988

[51] Int. Cl.[4] ..... B65D 5/46; B65D 5/48

[52] U.S. Cl. ..... 229/117.16; 229/120.26; 229/120.27

[58] Field of Search ..... 229/120.24, 120.26, 229/120.27, 120.29, 120.31, 120.38, 52 B, 52 BC; 206/180–191

[56] References Cited

U.S. PATENT DOCUMENTS

| | | | |
|---|---|---|---|
| 2,284,385 | 5/1942 | Freshwaters | 229/52 B |
| 2,754,028 | 7/1956 | Bergstein | 206/180 |
| 3,048,318 | 8/1962 | Sabin | 229/120.38 |
| 3,107,811 | 10/1963 | Lemon | 229/52 B |
| 3,138,285 | 6/1964 | Wenzel | 206/186 |
| 3,967,772 | 7/1976 | Baker | 229/120.37 |
| 4,157,755 | 6/1979 | Gough | 229/52 BC |
| 4,757,938 | 7/1988 | Collins | 229/52 B |
| 4,757,939 | 7/1988 | Zimmerman | 229/120.26 |

FOREIGN PATENT DOCUMENTS

| | | | |
|---|---|---|---|
| 1025408 | 1/1978 | Canada | 229/52 B |

*Primary Examiner*—Gary Elkins

*Attorney, Agent, or Firm*—Fetherstonhaugh & Co.

[57] ABSTRACT

The handle reinforcing portion of a combined divider and handle reinforcing insert for a paperboard carton is formed with a three-ply thickness. The blank from which the divider is formed has first and second divider panels and first and second handle panels. A first handle reinforcing sub-panel is severed from the first divider panel and extends longitudinally inwardly from a first end edge of the first divider panel and is hingedly connected to the lower edge of the first handle panel along a hinge line. A second handle reinforcing sub-panel is hingedly attached to the second edge of one of the first or second handle panels and extends longitudinally therefrom. The first and second sub-panels are located between the first and second handle panels and having a combined surface area substantially matching that of the first handle panel to provide a third ply of thickness between the first and second handle panels when they are secured to one another.

4 Claims, 5 Drawing Sheets

CARTON DIVIDER INCORPORATING 3-PLY LIFTING HANDLE

FIELD OF INVENTION

Figure 1:
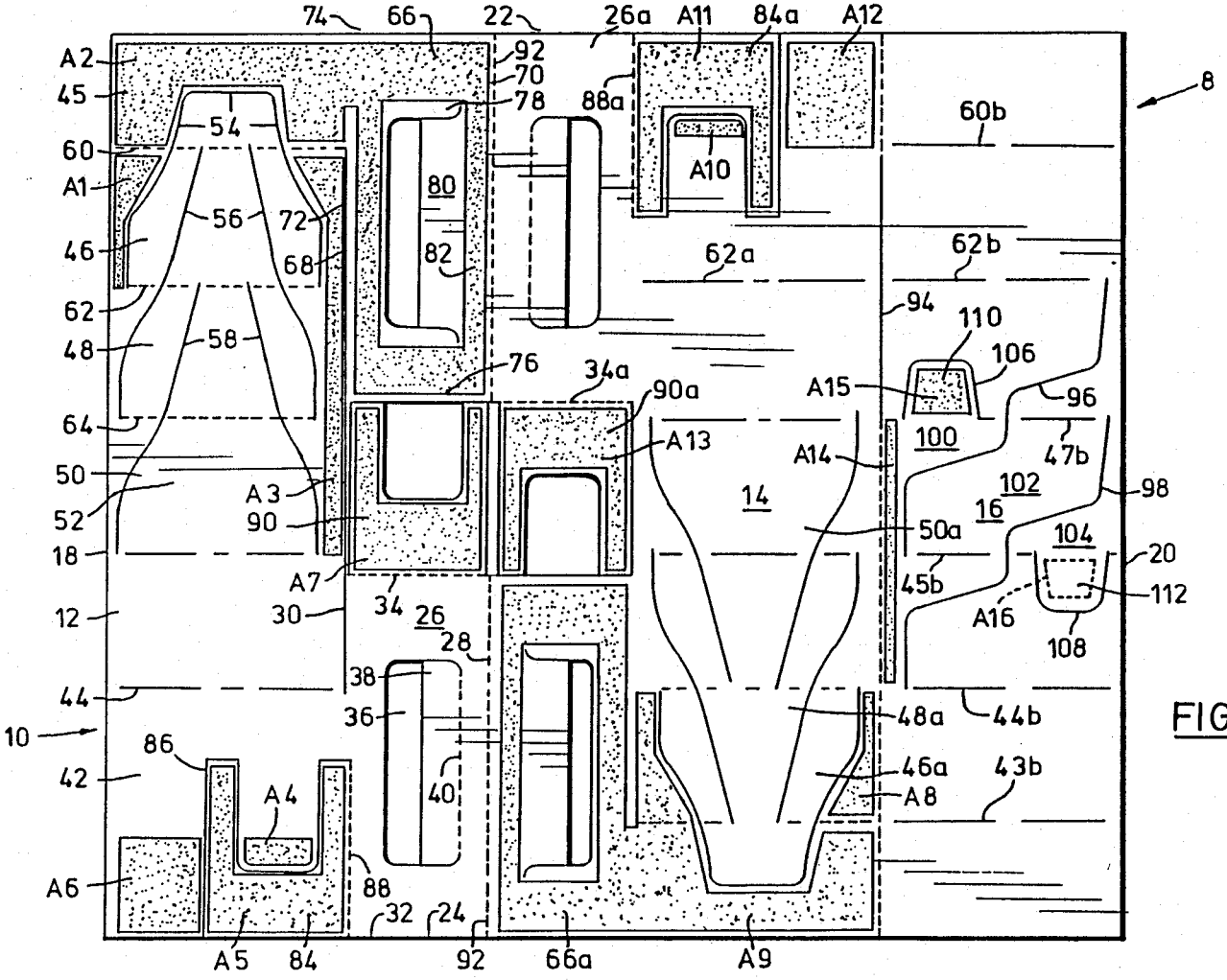

This invention relates to cartons and in particular, a reinforced handle for a carton.

PRIOR ART

Paperboard cartons are becoming increasingly popular as cartons for transporting heavy items such as beer bottles. Cartons of this type frequently have a hand opening in oppositely disposed end walls which permit the portion of the end wall which extends upwardly from the hand opening to act as a handle for use when the carton is to be carried. While it is customary to provide two hand openings, in practice customers frequently carry this type of carton in one hand with the result that the entire weight of the goods is applied to one of the handles. When the wall of the carton is made from a single ply paperboard, there is a substantial risk that this single ply may tear unless a very heavy gage of paperboard is used. The heavier the gage of paperboard used in the construction of the carton, the more expensive the carton is to produce. Relatively lightweight paperboard can be used in the construction of the remainder of the carton and consequently every effort is made to minimize the thickness of the paperboard from which the carton is manufactured.

It is also known to form a handle panel as an integral part of a divider and to attach the handle panel to the end wall of the carton so that it's hand opening is aligned with the hand opening of the end wall. This technique can be used to achieve a local increase in thickness in the area of the hand opening which serves to reinforce the handle.

We have found that it is possible to obtain a three-ply thickness of reinforcing paperboard in the area of the handle using material struck from a rectangular-shaped divider blank.

It is an object of the present invention to provide a combined divider and handle reinforcing insert for a carton which will provide a three-ply handle reinforcement panel assembly.

SUMMARY OF INVENTION

According to one aspect of the present invention, there is provided a combined divider and handle reinforcing insert for a paperboard carton of the type having a hand opening in at least one end wall thereof, comprising first and second divider panels each having an upper edge and a lower edge and oppositely disposed first and second end edges, first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, a first handle reinforcing sub-panel is severed from the first divider panel and extends longitudinally inwardly from the first end edge of the first divider panel and is hingedly connected to the lower edge of the first handle panel along a second hinge line, a second handle reinforcing sub-panel is hingedly attached to the second edge of one of said first or second handle panels and extends longitudinally therefrom, said first and second sub-panels being located between said first and second handle panels and having a combined surface area substantially matching that of the first handle panel to provide a third ply of thickness between the first and second handle panels when they are secured to one another.

According to a further aspect of the present invention, there is provided in a carton having first and second oppositely disposed end wall, a first handle opening formed in the first end wall, the improvement of a combined divider and handle reinforcing insert comprising first and second divider panels each having an upper edge and a lower edge and oppositely disposed first and second end edges, first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, second and third hand openings in the first and second panels respectively, said second and third hand openings being arranged to be aligned with one another when the first and second handle panels are folded along the first hinge line, a first handle reinforcing sub-panel which is severed from the first divider panel and extends longitudinally inwardly from the first end edge of the first divider panel and is hingedly connected to the lower edge of the first handle panel along a second hinge line, a second handle reinforcing sub-panel is hingedly attached to the second edge of one of said first or second handle panels and extends longitudinally therefrom, said first and second sub-panels being located between said first and second handle panels and having a combined surface area substantially matching that the first handle panel to provide a third ply of thickness between the first and second handle panels when they are secured to one another, said second handle panel being secured to said first end wall of said carton with the hand openings of the handle panels aligned with the first hand opening of the first end wall such that the handle panels serve to provide a three-ply reinforcement on the first end wall in the area of the first hand opening.

PREFERRED EMBODIMENT

Figure 2:
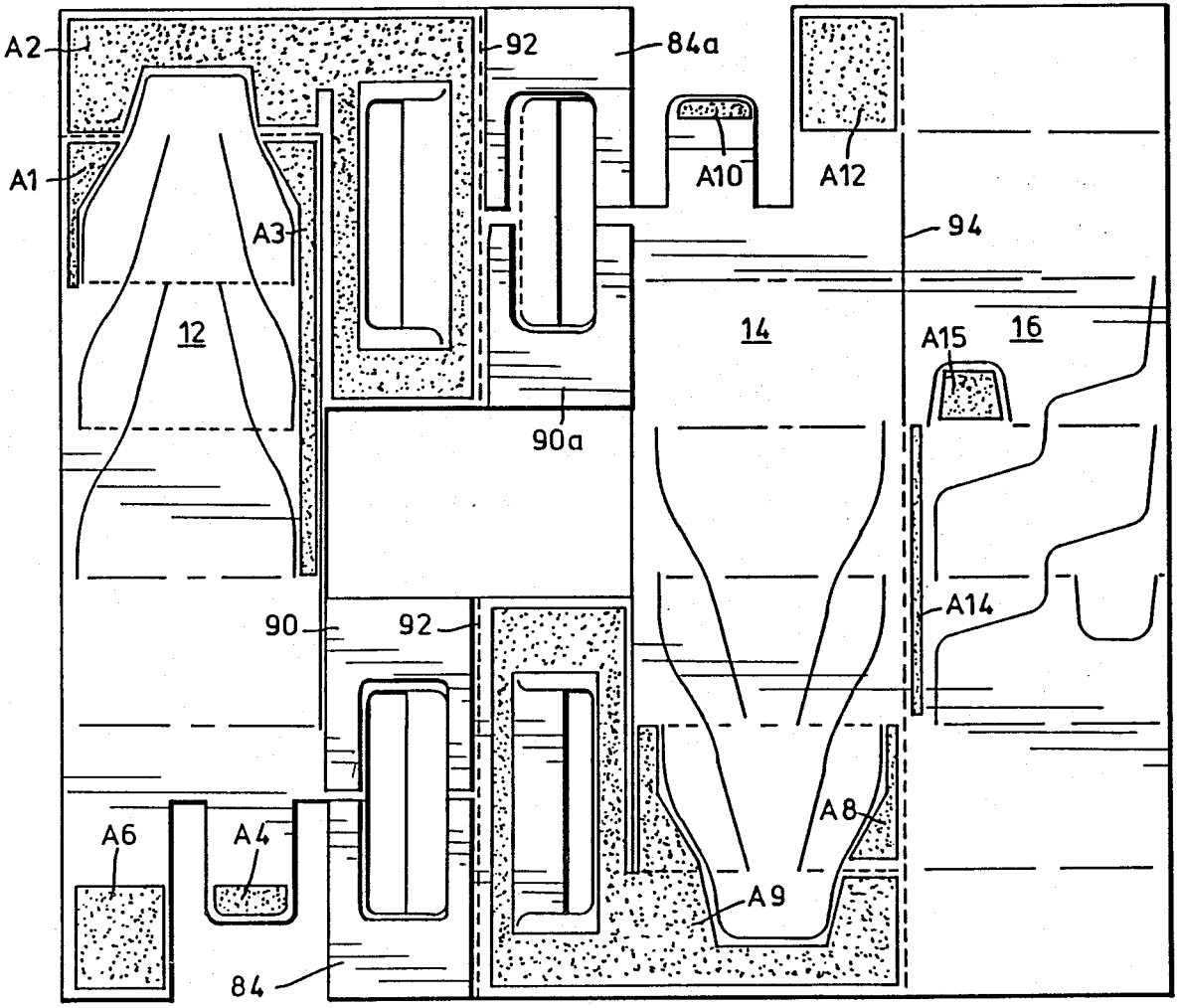
Figure 3:
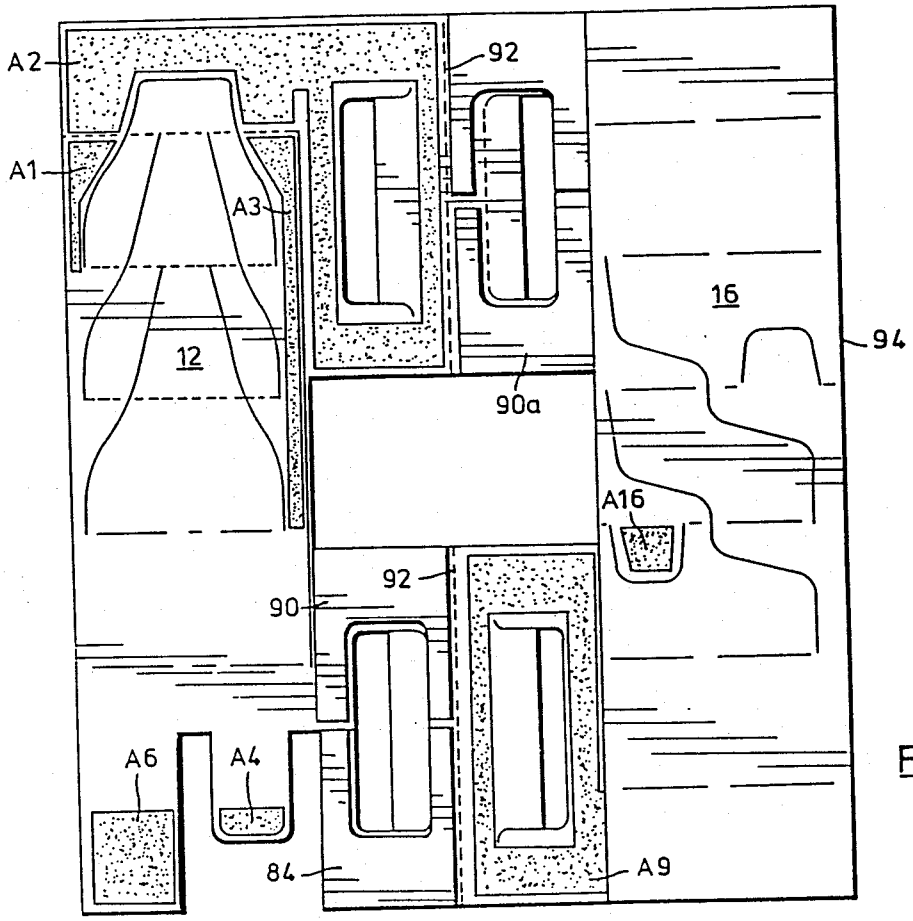
Figure 4:
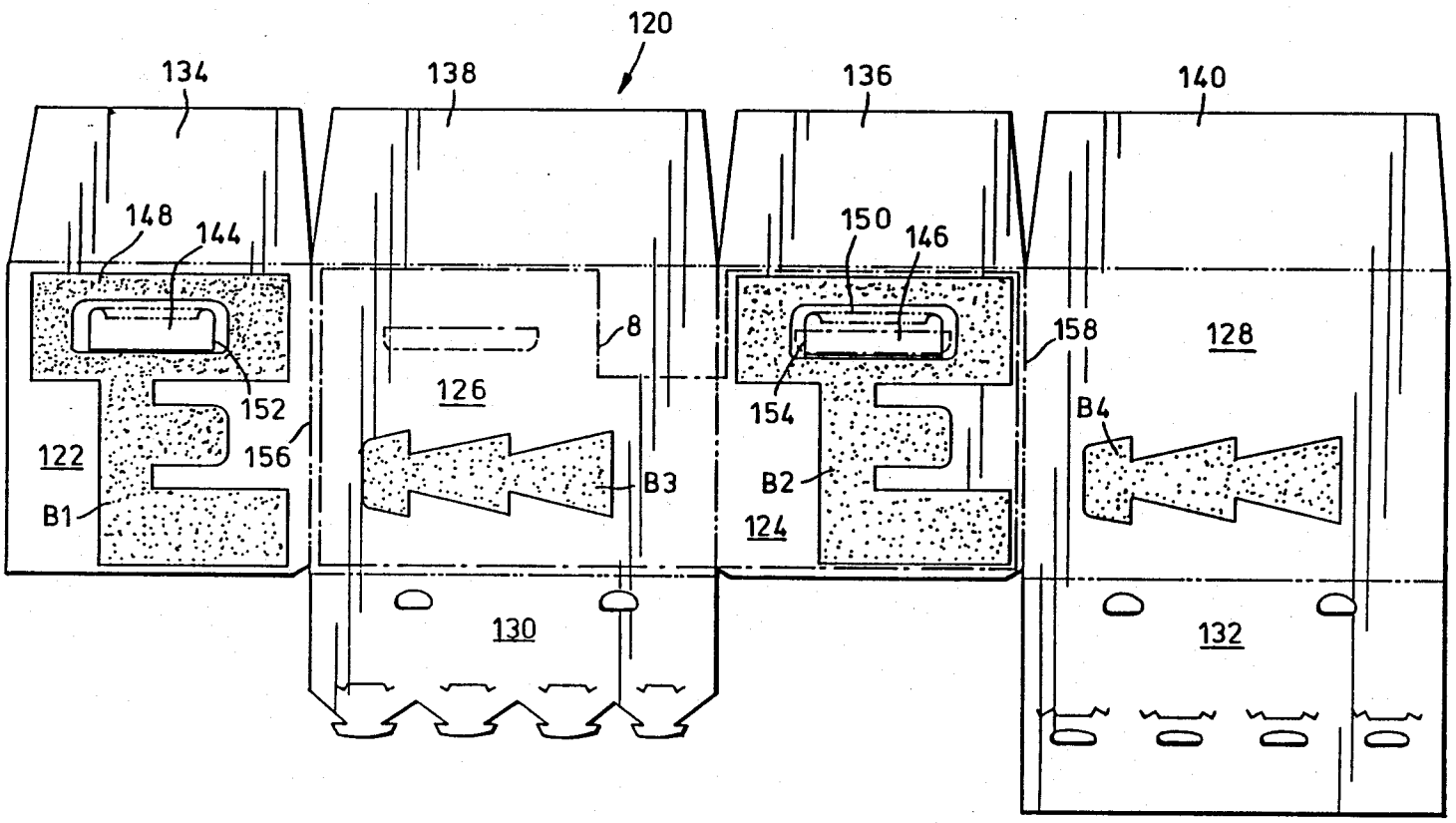
Figure 5:
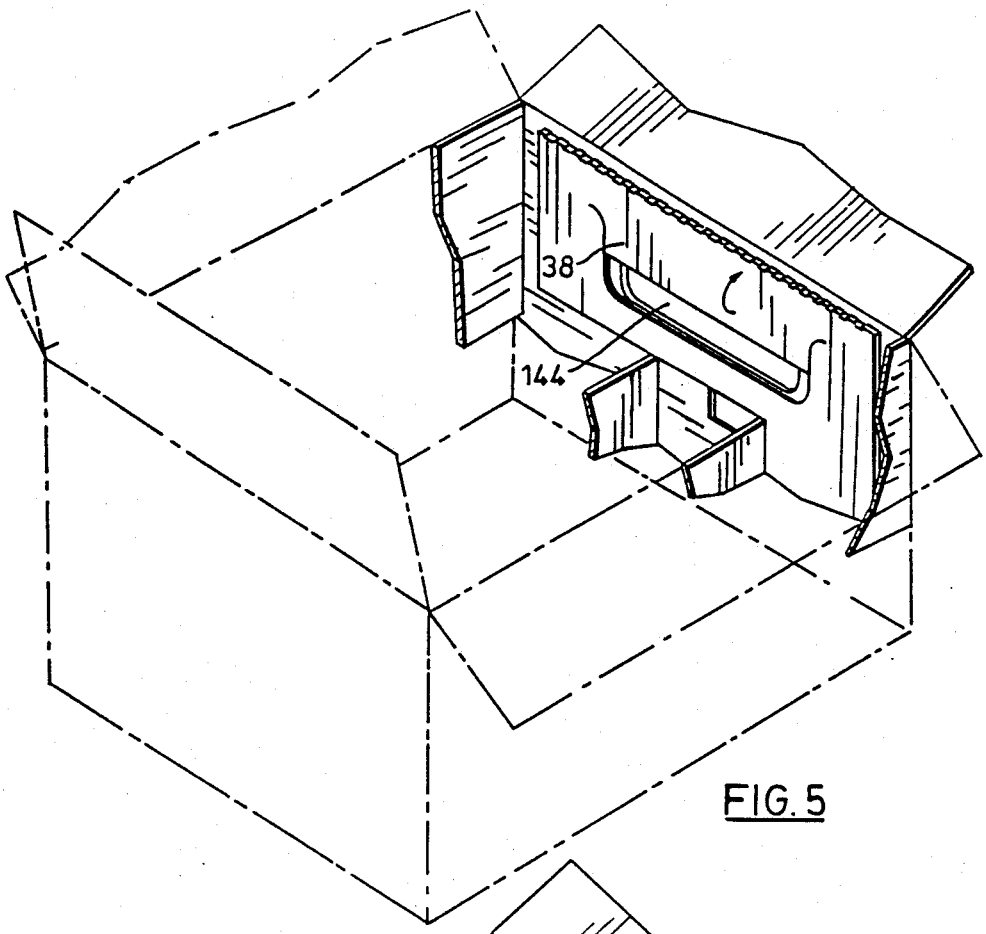
Figure 6:
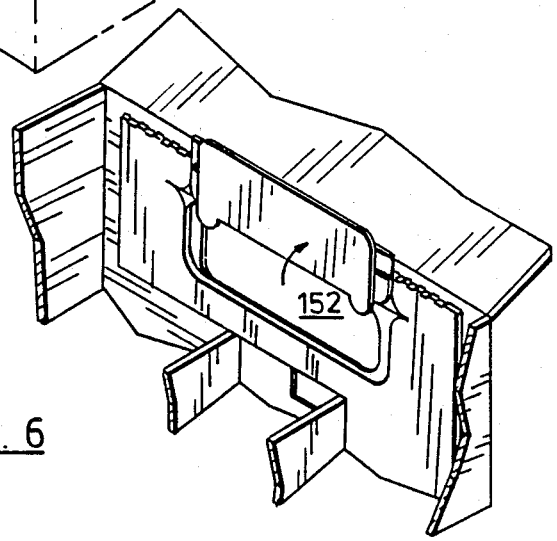

The invention will be more clearly understood after reference to the following detailed specification read in conjunction with the drawings wherein;

FIG. 1 is a plan view of a blank which has been cut and scored for use in the assembly of a combined divider and handle reinforcing insert according to a embodiment of the present invention, FIG. 2 is a plan view similar to FIG. 1 showing a number of folding steps required to position the sub-panels prior to the folding of the divider panels during the assembly of the divider, FIG. 3 is plan view showing a further step in the assembly of the combined divider and handle reinforcing insert of FIG. 2, FIG. 4 is a plan view of a carton blank of the type in which the insert of the present invention is mounted in use, FIG. 5 shows the blank of FIG. 4 in an assembled position and indicates the position of the handle reinforcing panel, FIG. 6 is a view of the handle area of FIG. 5 showing the hand flaps folded inwardly.

With reference to FIG. 1 of the drawings, the reference numeral 10 refers generally to a paperboard blank which is suitable for use in producing a combined divider and handle reinforcing insert. The blank 10 comprises a first divider panel 12, a second divider panel 14 and a third divider panel 16. The blank 10 has oppositely disposed side edges 18 and 20 and oppositely disposed end edges 22 and 24 which define a rectangle.

A first handle panel 26 has an upper edge 28 and a lower edge 30 which extend longitudinally thereof. The first handle panel 26 also has a first end edge 32 and a second end edge 34. A hand opening 36 is formed in the first handle panel 26 and extends longitudinally thereof. A handle flap 38 is hingedly connected to the first handle panel 26 along a hinge line 40.

The first divider panel 12 has an end portion 42 extending inwardly from the end edge 24 of the blank to a weakened fold line 44. A further end portion 45 extends inwardly from the other end edge 22 of the blank. Three lateral divider arms 46, 48 and 50 are formed by cutting the central portion 52 of the first divider panel along lines 54, 56 and 58 and by providing weakened fold lines 60, 62 and 64. A handle panel 66 which is hereinafter referred to as the fourth handle panel is connected to the end portion 45 of the first divider panel 12 and is separated from the remainder of the first divider panel along a cut line 68 which extends over a major portion of the length thereof from the fold line 60. The fourth handle panel has an upper edge 70, a lower edge 72, a first end edge 74 and a second end edge 76. A hand opening 78 is formed in the fourth handle panel 66. A handle flap 80 is connected to the fourth handle panel 66 along a hinge line 82.

A first handle reinforcing sub-panel 84 is severed from the first divider panel along a cut line 86 which extends continuously inwardly from the end edge 24 of the blank to the point where it meets an inner end of a weakened hinge line 88 which is hereinafter identified as the second hinge line. The first reinforcing sub-panel has a generally U-shaped configuration and corresponds in area to about ½ of the area of the first handle panel 26.

A second handle reinforcing sub-panel 90 is shaped in proportion to correspond about to ½ of the reinforcing end panel 26 and is connected thereto along the second end edge 34 of the first handle panel 26.

The second divider panel 14 has a second handle panel **26*a* and a third handle panel 66*a*, a third handle reinforcing sub-panel 84*a* and a fourth handle reinforcing sub-panel 90*a* which are connected thereto in a like manner to that in which the corresponding components are attached with respect to the first divider panel 12 and will not therefore be described in detail. It will be noted, however, that the upper edges of the handle panels 24 and 66*a* are hingedly connected along a fold line 92 as are the upper edges of the third and fourth handle panels 26*a* and 66. A plurality of lateral divider arms 46*a*, 48*a* and 50*a* are formed in the second divider panel 14 in a like manner to the panels 46, 48 and 50 of the first divider panel 12**.

The third divider panel 16 is hingedly connected to the second divider panel 14 along a longitudinal fold line 94. The third divider panel is cut along the lines 96 and 98 to form lateral divider arms 100, 102 and 104. The third divider panel 16 is also cut along the cut lines 106 and 108 to form anchor tabs 110 and 112. Weakened fold lines **43*b*, 44*b*, 45*b*, 47*b*, 62*b* and 60*b* extend across the third divider panel 16 and are aligned with the fold line 43. Additional weakened fold line 60*a* extends across the panel 16 and is aligned with the fold line 60 of the first divider panel 12**.

An adhesive coating is applied to the areas A1, A2, A3, A4, A5 and A6 of the first divider panel 12. It will be noted that the area A2 also extends around the perimeter of the hand opening of the fourth handle panel 66. Adhesive is also applied to the area A7 which covers the major portion of the face of the second sub-flap 90.

Adhesive is also applied to the areas A8, A9, A10, A11, A12 of the second divider panel 14 and to area A13 of the sub-panel **90*a*. Adhesive is also applied to the areas A14, A15 and A16 of the third divider panel 16. It will be noted that the area A16 which is located on the anchor tab 116 is an area under the underside of the blank as shown in FIG. 1**.

In order to preassemble the combined divider hand handle reinforcing insert 8, a series of folding steps are carried out, the first of which include the steps required to position the sub-panels 84, 90, **84*a* and 90*a*. This first folding step is illustrated in FIG. 2 of the drawings. It will be noted that the sub-panels 84, 84*a* are struck from a portion of the first and second divider panels 12 and 14 respectively which is not required for the purposes of forming a transverse divider arm. It will also be noted that the sub-panels 90 and 90*a*** are struck from a portion of the blank which is not required for the purposes of manufacturing the handle.

When the sub-panels 84, 90, **84*a* and 90*a* are folded to the position shown in FIG. 2, they are adhesively secured to the underlying handle panels by means of the adhesive patches A5, A13, A10 and A13 (FIG. 1**).

The next folding step is illustrated in FIG. 3 of the drawings wherein the blank is folded along the fold line 94 in order to position the third divider panel 16 in a face-to-face overlying relationship with respect to the second divider panel 14. As a result, the adhesive patches A14 and A15 of the third divider panel 16 become attached to the opposite face of the second divider panel 14 and a portion of the adhesive patch A9 together with the patches A8, A10 and A12 form an adhesive bond between the second divider panel 14 and the third divider panel 16.

The blank is then folded along the fold line 92 to position the first divider panel in a face-to-face relationship with respect to the third divider panel 16 and to locate the handle panels in a face-to-face relationship. As a result, the adhesive patches A1, A2, A3, A4, A6, A16 and a remaining portion of the patch A9 will serve to secure the panels in the required face-to-face relationship.

The thus preassembled blank combined divider and handle reinforcing insert is now suitably arranged for attachment to a carton blank.

A carton blank 120 of a type suitable for producing a carton of the type within which the combined divider and handle reinforcing insert may be mounted is illustrated in FIG. 4.

The carton blank 120 is formed with first and second end wall panels 122 and 124 and first and second side wall panels 126 and 128. Bottom closure panels 130 and 132 are hingedly connected to the side wall panels 126 and 128 respectively. Top closure flaps 134 and 136 are hingedly connected to the end walls 122 and 124 respectively and too closure flaps 138 and 140 are hingedly connected to the side walls 126 and 128 respectively. A side flap 142 is connected to the free end of the side wall panel 128. Handle flaps 144 and 146 are formed in the handle panels 122 and 124 respectively. The flaps 144 and 146 are connected to the end walls 122 and 124 along hinge lines 148 and 150. The flaps 144 and 146 can be folded along their hinge lines 146 and 148 to provide hand opening 152 and 154 in the end walls 122 and 124 respectively. Adhesive patches B1 and B2 are applied to the inner face of the end walls 122 and 124 respectively and adhesive patches B3 and B4 are applied to the side walls 126 and 188 respectively.

The preassembled combined divider and handle reinforcing insert 8 is then positioned with one or other of the first or second divider panels located in a face-to-face relationship with respect to the side and end wall panels 124 as shown in broken lines in FIG. 4. As a result, the adhesive patch B3 serves to secure the overlying end portions of the transverse divider arms 54, 56 and 58. Similarly, the glue patch B2 serves to secure the handle panel 26 and the portion of the first divider 12 which is located between the weakened fold line 44 and the side edge 24 to the end wall 124.

The carton blank is then folded along the fold lines 156 and 158 to position the side wall 128 and end wall 122 in a face-to-face relationship with respect to the outer face of the second divider panel 14 to cause the adhesive patches B1 and B4 to be attached to the underlying portions of the divider and handle panel in a like manner to that described with respect to the glue patches B2 and B3.

The carton is now assembled to a knock-down configuration and is retained in this position by the fact that the flap 42 is adhesively connected to the end wall 122 in a conventional manner.

The carton is then folded to an erect configuration and the bottom wall is closed in a conventional manner. As a result of the movment of the carton to the erect configuration, the divider panels will automatically assume a position in which they divide the container spaced within the compartment into twelve bottle storage compartments arranged in three rows of four compartments.

FIG. 5 of the drawings serves to illustrate the carton in the open configuration. To gain access to the hand opening, it is merely necessary to fold the flaps 144 inwardly and this in turn will cause the handle flaps 38 to fold inwardly to provide the hand opening 152.

It will be apparent from the foregoing that in the handle area immediately surrounding the hand openings 152 and 154, four plies of paperboard are provided, three of which are provided by the handle reinforcing insert. As a result, the handles of the carton will be considerably stronger than the single ply paperboard from which the remainder of the carton is reduced.

Various modifications of the present invention will be apparent to those skilled in the art.

It will be apparent that if the carton insert of the present invention is to be used in combination with a carton in which only one hand opening is provided, the same combined divider and handle reinforcing insert may be employed or the handle panels which are used to produce one of the handles may be removed during . the blank forming operation.

It will also be apparent that when preassembled, the appearance of the outer faces of the first and second divider panels is identical with the result that the outer face of the second panel can be positioned on the panels 124 and 126 of the carton, rather than the outer face of the first divider panel as previously described without affecting the finished product. Consequently, it is not necessary to carefully examine the preassembled reinforcing insert before positioning it on the carton blank.

These and other advantages of the present invention will be apparent to those skilled in the art.

We claim:

1. A combined divider and handle reinforcing insert for a paperboard carton of the type having a hand opening in at least one end wall thereof, comprising (a) first and second divider panels each having an upper edge and a lower edge and oppositely disposed first and second end edges, (b) first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, (c) a first handle reinforcing sub-panel is severed from the first divider panel and extends longitudinally inwardly from the first end edge of the first divider panel and is hingedly connected to the lower edge of the first handle panel along a second hinge line, (d) a second handle reinforcing sub-panel is hingedly attached to the second edge of one of said first or second handle panels and extends longitudinally therefrom, (e) said first and second sub-panels being located between said first and second handle panels and having a combined surface area substantially matching that of the first handle panel to provide a third ply of thickness between the first and second handle panels when they are secured to one another.

2. A combined divider and handle reinforcing insert for a paperboard carton of the type having a hand opening in each of two oppositely disposed end walls, comprising (a) first and second divider panels each having an upper edge and a lower edge and oppositely disposed first and second end edges, (b) first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, (c) a first handle reinforcing sub-panel is severed from the first divider panel and extends longitudinally inwardly from the first end edge of the first divider panel and is hingedly connected to the lower edge of the first handle panel along a second hinge line, (d) a second handle reinforcing sub-panel is hingedly attached to the second edge of one of said first or second handle panels and extends longitudinally therefrom, (e) said first and second sub-panels being located between said first and second handle panels and having a combined surface area substantially matching that of the first handle panel to provide a third ply of thickness between the first and second handle panels when they are secured to one another, (f) third and fourth divider panels each having an upper edge and a lower edge and oppositely disposed first and second end edges, (g) third and fourth handle panels each having upper and lower edges and oppositely disposed first and second end edges, the lower edges of the third and fourth handle panels being connected to the upper edge of the second and first divider panels respectively, the third and fourth handle panels extending longitudinally inwardly from the second end edge of the divider panels and having their second end edge disposed opposite to and spaced from the second end edges of the first and second handle panel respectively, the upper edges of the third and fourth handle panels being hingedly connected to one another along a first hinge line, (h) a third handle reinforcing sub-panel is severed from the second divider panel and extends longitudinally inwardly from the second end edge of the second divider panel and is hingedly connected to the lower edge of the third handle panel along a fourth hinge line, (i) a fourth handle reinforcing sub-panel is hingedly attached to the second edge of one of said third or fourth handle panels and extends longitudinally therefrom in a side-by-side relationship with respect to the second handle reinforcing sub-panel, (j) said third and fourth sub-panels being located between said third and fourth handle panels and having a combined surface area substantially matching that of the first handle panel to provide a third ply of thickness between the first and second handle panels when they are secured to one another.

3. In a carton having first and second oppositely disposed end wall, a first handle opening formed in the first end wall, the improvement of a combined divider and handle reinforcing insert comprising;

(a) first and second divider panels each having an upper edge and a lower edge and oppositely disposed first and second nd edges, (b) first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, (c) second and third hand openings in the first and second panels respectively, said second and third hand openings being arranged to be aligned with one another when the first and second handle panels are folded along the first hinge line, (d) a first handle reinforcing sub-panel which is severed from the first divider panel and extends longitudinally inwardly from the first end edge of the first divider panel and is hingedly connected to the lower edge of the first handle panel along a second hinge line, (e) a second handle reinforcing sub-panel is hingedly attached to the second edge of one of said first or second handle panels and extends longitudinally therefrom, (f) said first and second sub-panels being located between said first and second handle panels and having a combined surface area substantially matching that of the first handle panel to provide a third ply of thickness between the first and second handle panels when they are secured to one another, (g) said second handle panel being secured to said first end wall of said carton with the hand openings of the handle panels aligned with the first hand opening of the first end wall such that the handle panels serve to provide a three-ply reinforcement on the first end wall in the area of the first hand opening.

4. In a carton having first and second oppositely disposed end wall and first and second handle openings formed in the first and second end walls respectively, the improvement of a combined divider and handle reinforcing insert comprising;

(a) first and second divider panels each having an upper edge and a lower edge and oppositely disposed first and second end edges, (b) first and second handle panels each having upper and lower edges and oppositely disposed first and second end edges, the lower edges of the first and second handle panels being connected to the upper edge of the first and second divider panels respectively, the first and second handle panels extending longitudinally inwardly from the first end edge of the divider panels, the upper edges of the first and second handle panels being hingedly connected to one another along a first hinge line, (c) second and third hand openings in the first and second panels respectively, said second and third hand openings being arranged to be aligned with one another when the first and second handle panels are folded along the first hinge line, (d) a first handle reinforcing sub-panel which is severed from the first divider panel and extends longitudinally inwardly from the first end edge of the first divider panel and is hingedly connected to the lower edge of the first handle panel along a second hinge line, (e) a second handle reinforcing sub-panel is hingedly attached to the second edge of one of said first or second handle panels and extends longitudinally therefrom, (f) said first and second sub-panels being located between said first and second handle panels and having a combined surface area substantially matching that of the first handle panel t provide a third ply of thickness between the first and second handle panels when they are secured to one another, (g) said second handle panel being secured to said first end wall of said carton with its hand opening aligned with the first hand opening of the first end wall such that the handle panels serve to provide a three-ply reinforcement on the first end wall in the area of the first hand opening, (h) third and fourth divider panels each having an upper edge and a lower edge and oppositely disposed first and second end edges, (i) third and fourth handle panels each having upper and lower edges and oppositely disposed first and second end edges, the lower edges of the third and fourth handle panels being connected to the upper edge of the second and first divider panels respectively, the third and fourth handle panels extending longitudinally inwardly from the second end edge of the divider panels and having their second end edge disposed opposite to and spaced from the second end edges of the first and second handle panel respectively, the upper edges of the third and fourth handle panels being hingedly connected to one another along a first hinge line, (j) a third handle reinforcing sub-panel is severed from the second divider panel and extends longitudinally inwardly from the second end edge of the second divider panel and is hingedly connected to the lower edge of the third handle panel along a fourth hinge line, (k) a fourth handle reinforcing sub-panel is hingedly attached to the second edge of one of said third or fourth handle panels and extends longitudinally therefrom in a side-by-side relationship with respect to the second handle reinforcing sub-panel, (l) said third and fourth sub-panels being located between said third and fourth handle panels and having a combined surface area substantially matching that of the first handle panel to provide a third ply of thickness between the third and fourth handle panels when they are secured to one another, (m) said fourth handle panel being secured to said second end wall of said carton with its hand opening aligned with the second hand opening of the second end wall such that the handle panels serve to provide a three-ply reinforcement on the second end wall in the area of the first hand opening.

* * * * *